US007079078B2

(12) United States Patent
Yuanzhu

(10) Patent No.: US 7,079,078 B2
(45) Date of Patent: Jul. 18, 2006

(54) PATCH ANTENNA APPARATUS PREFERABLE FOR RECEIVING GROUND WAVE AND SIGNAL WAVE FROM LOW ELEVATION ANGLE SATELLITE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/812,334

(22) Filed: Mar. 29, 2004

(65) Prior Publication Data

US 2004/0201524 A1 Oct. 14, 2004

(30) Foreign Application Priority Data

Apr. 9, 2003 (JP) ..... 2003-105401
Apr. 9, 2003 (JP) ..... 2003-105561
Apr. 9, 2003 (JP) ..... 2003-105565

(51) Int. Cl.
*H01Q 1/38* (2006.01)
*H01Q 1/42* (2006.01)

(52) U.S. Cl. ..... 343/700 MS; 343/789
(58) Field of Classification Search ..... 343/700 MS, 343/789, 841, 846
See application file for complete search history.

(56) References Cited

U.S. PATENT DOCUMENTS 6,181,279 B1 * 1/2001 Van Hoozen ..... 343/700 MS
6,731,243 B1 * 5/2004 Taira et al. ..... 343/700 MS
6,756,942 B1 * 6/2004 Heyde ..... 343/700 MS
6,801,167 B1 * 10/2004 Shibata ..... 343/700 MS

FOREIGN PATENT DOCUMENTS

JP 06-224620 8/1994
JP 2003-234617 8/2003

* cited by examiner

*Primary Examiner*—Hoang V. Nguyen
(74) *Attorney, Agent, or Firm*—Brinks Hofer Gilson & Lione

(57) ABSTRACT

A patch antenna apparatus includes an antenna element and a metal frame, which are disposed on a ground plane. The antenna element has a dielectric substrate, which has a patch electrode on the top surface and has a ground electrode on the bottom surface. The patch electrode is connected to current-feed pins. The metal frame is positioned so as to surround the peripheral surface of the dielectric substrate. The height dimension of the metal frame is set to be slightly larger than the thickness dimension of the dielectric substrate. Electromagnetic radiation radiated from the antenna element is reflected upon reaching the metal frame. Thus, the metal frame causes interference with the electromagnetic radiation such that the traveling direction of the electromagnetic radiation is redirected closer to the lateral direction.

38 Claims, 5 Drawing Sheets

PATCH ANTENNA APPARATUS PREFERABLE FOR RECEIVING GROUND WAVE AND SIGNAL WAVE FROM LOW ELEVATION ANGLE SATELLITE

This application claims the benefit of Japanese Patent Applications 2003-105565, 2003-105561, and 2003-105401, filed on Apr. 9, 2003, which are incorporated herein by reference.

BACKGROUND OF THE INVENTION

1. Field of the Invention

The present invention relates to a patch antenna apparatus for use as a vehicle-mounted small antenna or the like, and more particularly, to beam shaping of the radiation patterns of the patch antenna apparatus.

2. Description of the Related Art

Patch antennas are planar antennas in which a dielectric substrate having a patch electrode on the top surface is disposed on a ground plane and a predetermined high-frequency current is fed to the patch electrode via current-feed pins or the like. The patch antennas are widely used as vehicle-mounted small antennas and the like for receiving satellite waves. In order for the patch antennas to achieve a high gain, the ground plane needs to have a sufficiently large area compared to the patch electrode. Further, for stabilization of the performance of the patch antennas, many patch antennas have a configuration in which an opposing ground electrode is provided on the bottom surface of the dielectric substrate to be in contact with or in close proximity of the ground plane (e.g., Japanese Unexamined Patent Application Publication No. 6-224620, pp. 2–4, FIG. 1).

Typically, since the maximum radiation direction of the patch antennas is directly above the patch electrode, the patch antennas installed on, for example, the roof surfaces of vehicles can efficiently receive signal waves from a satellite located in the vicinity of the zenith.

However, the patch antennas having a maximum radiation direction at the zenith cannot efficiently receive ground waves. Thus, in a system in which a ground-based repeater receives signal waves from a satellite (e.g., an S-band digital audio radio satellite currently being planned) and re-transmits the signal waves, when such a known patch antenna is installed on the roof surface of a vehicle or the like, the antenna cannot be used as a planar antenna for receiving ground waves from the repeater. Consequently, a need arises for an antenna sticking up high, such as a pole antenna. Also, the antennas having the maximum radiation direction at the zenith are not suitable for receiving signal waves from a low elevation-angle satellite.

SUMMARY OF THE INVENTION

Accordingly, embodiments of the present invention provide a patch antenna apparatus that better receives ground waves and signal waves from a low elevation-angle satellite.

To achieve the foregoing, a first aspect of the present invention provides a patch antenna apparatus. In the patch antenna apparatus, a patch electrode is provided on the upper surface of a dielectric substrate disposed above a ground plane and is connected to current-feed means, and a metal frame is positioned so as to surround the peripheral surface of the dielectric substrate.

With this arrangement, when radio waves radiated in response to a change in the electric field between the patch electrode and the ground electrode reaches the metal frame, they are reflected. Thus, when radio waves traveling in the same phase are emitted beyond the metal frame, the traveling direction thereof is changed downward. As a result, this patch antenna apparatus has a reduced gain directly above the patch electrode and its maximum radiation direction changes from directly above the patch electrode to obliquely upward. That is, the beams are shaped so that the maximum radiation direction is at a low elevation angle. Thus, even when installed on the roof surface of a vehicle or the like, this patch antenna apparatus can efficiently receive ground waves and signal waves from a low elevation-angle satellite.

With this arrangement, as the height dimension of the metal frame is closer to that of the dielectric substrate, the metal frame can be set lower. However, the resonant frequency bandwidth can be increased when space is provided between the metal frame and the dielectric substrate. Thus, a tradeoff exists between the profile and the resonant frequency bandwidth. It may in fact be preferable for the metal frame to be higher than the dielectric substrate is thick.

Preferably, a plan-view shape of the metal frame is substantially similar to a plan-view shape of the outer shape of the dielectric substrate. This arrangement can increase the space factor.

Another aspect of the present invention provides a patch antenna apparatus. In this patch antenna apparatus, a patch electrode is provided on the top surface of a dielectric substrate disposed above a ground plane and is connected to current-feed means. At least three bar-shaped conductors, each extending in the thickness direction of the dielectric substrate, are arranged in the dielectric substrate along the circumference direction of the dielectric substrate. The bar-shaped conductors are placed outside the patch electrode. The lower ends of the bar-shaped conductors are connected to the ground plane.

With this arrangement, in response to a change in the electric field between the patch antenna and the ground plane changes, current is induced in each bar-shaped conductor in the dielectric substrate. This puts each metal pin into a state in which a current is fed thereto at the same frequency as that of the patch electrode, so that each metal pin operates like a monopole antenna. The maximum radiation direction of the radio waves radiated from the patch electrode serving as a radiating conductor is directly above, whereas the maximum radiation direction of the radio waves radiated from each bar-shaped conductor serving as a radiating conductor is horizontal. Thus, a combined radiation pattern of both the radio waves has a flattened shape that is compressed from directly above. That is, this patch antenna apparatus has a reduced gain directly above the patch electrode and its maximum radiation direction changes from directly above the patch electrode to obliquely upward. Thus, even when installed on the roof surface of a vehicle or the like, this patch antenna apparatus can efficiently receive ground waves and signal waves from a low elevation-angle satellite.

Metal pins may be provided in the dielectric substrate so as to serve as the bar-shaped conductors. Alternatively, through-holes may be provided in the dielectric substrate so as to serve as the bar-shaped conductors. Such an arrangement can reduce a gain directly above the patch electrode. Thus, the beams are shaped so that the maximum radiation direction is at a low elevation angle. Accordingly, even when installed on the roof surface of a vehicle or the like, the patch antenna apparatus can efficiently receive ground waves and signal waves from a low-elevation satellite.

Still another aspect of the present invention provides a patch antenna apparatus. In this patch antenna apparatus, a patch electrode is provided on the top surface of a dielectric substrate disposed above a ground plane and is connected to current-feed means. At least three metal pins, each having an upright portion extending in the thickness direction of the dielectric substrate, are arranged at substantially regular intervals around the dielectric substrate. The lower end of each metal pin is connected to the ground plane and the upper end of the upright portion of each metal pin continues to a lateral metal member that is arranged above the dielectric substrate.

With this arrangement, radio waves radiated in response to a change in the electric field between the patch electrode and the ground substrate can be received and re-radiated by the metal pins. The maximum radiation direction of the radio waves radiated from the patch electrode serving as a radiating conductor is directly above. In contrast, the maximum radiation direction of the radio waves re-radiated from each the upright portion of each metal pin serving as a radiating conductor is horizontal, in the same manner as a monopole antenna. Thus, a combined radiation pattern of both the radio waves has a flattened shape compressed from directly above. This patch antenna apparatus, therefore, has a reduced gain directly above the patch electrode and its maximum radiation direction changes from directly above the patch electrode to obliquely upward. That is, the beams are shaped so that the maximum radiation direction is at a low elevation angle. Thus, even when installed on the roof surface of a vehicle or the like, this patch antenna apparatus can efficiently receive ground waves and signal waves from a low elevation-angle satellite.

In this embodiment, each metal pin may be a pin member in which the upper end of the upright portion is bent and the lateral metal member extends from the bent portion. This can provide a simple structure. Preferably, the metal pin has a substantially L shape in which the upper end of the upright portion is bent at a substantially right angle. This arrangement can reduce the height dimension.

DESCRIPTION OF THE PREFERRED EMBODIMENTS

Figure 1:
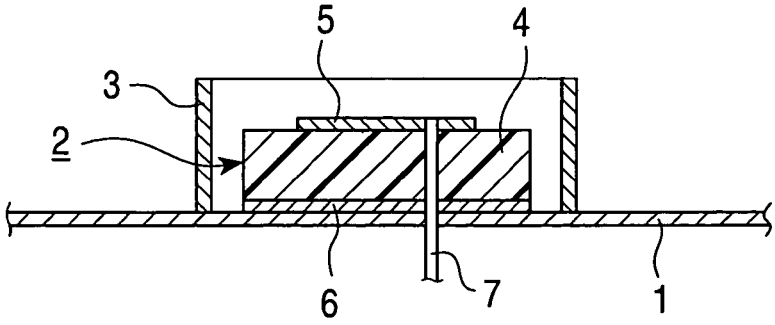
FIG. 1 is a longitudinal sectional view of a patch antenna apparatus according to a first embodiment of the present invention.
Figure 2:
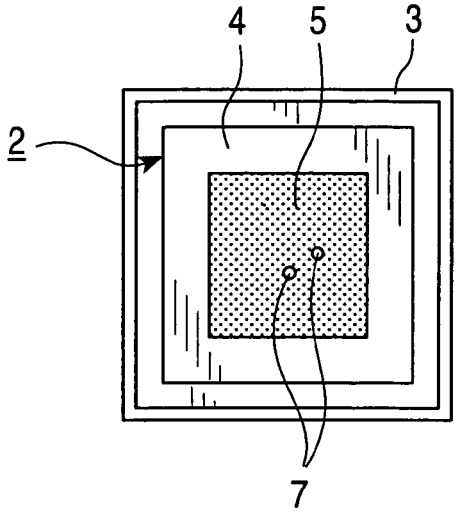
FIG. 2 is a plan view of the patch antenna apparatus of the first embodiment.
Figure 3:
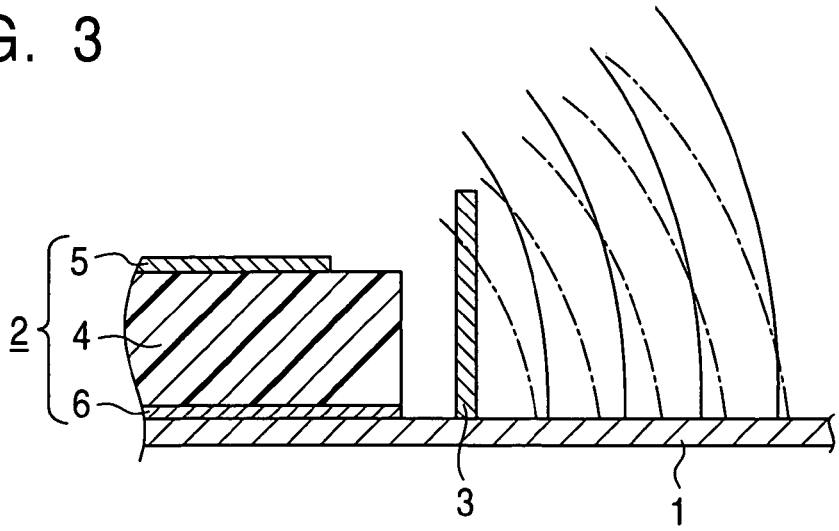
FIG. 3 is a schematic view showing a state in which radiation beams are shaped by a metal frame of the patch antenna apparatus.
Figure 8:
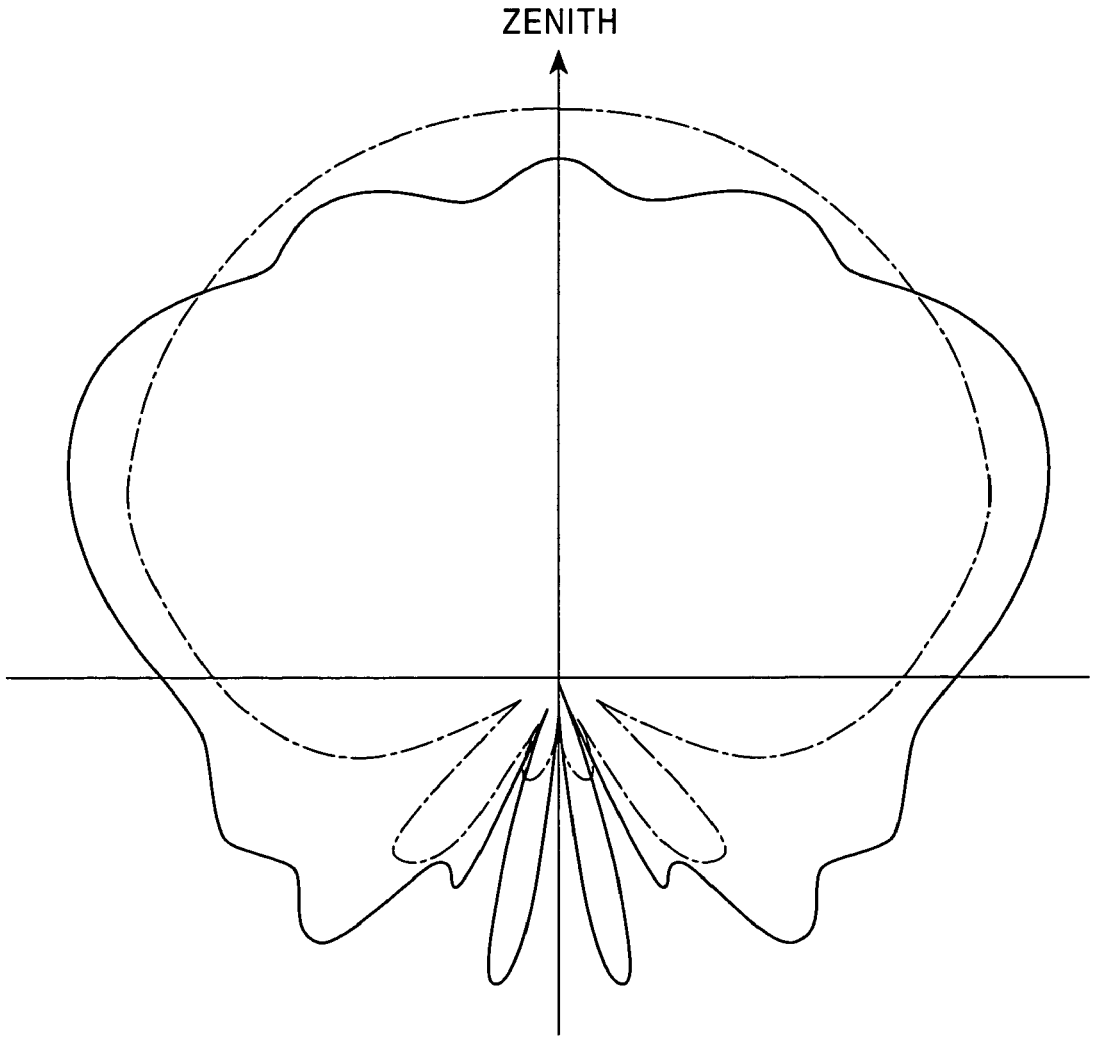
FIG. 8 is a graph showing the radiation pattern of the patch antenna apparatus according to the first embodiment in conjunction with a comparative example.

A first embodiment of the present invention will now be described with reference to the accompanying drawings. FIG. 1 is a longitudinal sectional view of a patch antenna apparatus according to a first embodiment of the present invention. FIG. 2 is a plan view of the patch antenna apparatus. FIG. 3 is a schematic view illustrating a state in which radiation beams are shaped by a metal frame of the patch antenna apparatus. FIG. 8 is a graph showing the radiation pattern of the patch antenna apparatus in conjunction with a comparative example.

The patch antenna apparatus shown in FIGS. 1 and 2 is generally constructed such that an antenna element 2 and a conductive (e.g. metal) frame 3 are disposed on a ground plane 1. The ground plane 1 may be the metal body of a vehicle or the like. The antenna element 2 includes a dielectric substrate 4, a patch electrode 5, a ground electrode 6, and current-feed pins 7. The dielectric substrate 4 is made of a dielectric material, such as a synthetic resin, and the patch electrode 5 is provided on the top surface of the dielectric substrate 4. The ground electrode 6 is provided on substantially the entire bottom surface of the dielectric substrate 4, and the current-feed pins 7 extend through the dielectric substrate 4 and are connected to the patch electrode 5. The current-feed pins 7 are also connected to a current-feed circuit, which is not shown. In this embodiment, the relative dielectric constant $\in r$ of the dielectric material used in the dielectric substrate 4 may be $\approx 6$. Depending on the dielectric material used, however, this value can change significantly. The patch electrode 5 has a 20×20 mm square shape for example. In order to receive circularly-polarized waves, the current-feed pins 7 are connected to appropriate two points of the patch electrode 5 and current is fed thereto via the two points.

The metal frame 3 is positioned to surround the peripheral surface (i.e., the side surfaces) of the dielectric substrate 4. The height dimension of the metal frame 3 is slightly larger than the thickness dimension of the dielectric substrate 4. In this embodiment, since the outer shape of the dielectric substrate 4 is square in plan view, the metal frame 3 is also shaped to be substantially square in plan view so that the distance between the dielectric substrate 4 and the metal frame 3 are maintained to be uniform. Specifically, in the example shown in FIGS. 1 and 2, the dielectric substrate 4 is a square plate with a side length of 30 mm and a thickness dimension of 6 mm. On the other hand, the metal frame 3 is arranged in a square with a side length of 32 mm and a height dimension of 8 mm. Thus, the figures are not drawn to scale.

In the patch antenna apparatus configured as described above, when a predetermined high-frequency current is fed to the patch electrode 5 via the current-feed pins 7, radio waves (electromagnetic radiation having a frequency of, for example, 2.338 GHz) are radiated in response to a change in the electric field between the patch electrode 5 and the ground plane 1 and/or the ground electrode 6. The radio waves are then reflected upon reaching the metal frame 3. As shown in FIG. 3, when going beyond the metal frame 3, radio waves traveling in the same phase receive interference that changes the traveling direction thereof downward. Thus, when the metal frame 3 is assumed to be absent, the same phase front of the beams radiated from the antenna element 2 is expressed as the curves indicated by the dotted lines shown in FIG. 3. In contrast, in this embodiment in which the antenna element 2 is surrounded by the metal frame 3, the same phase front of the radiation beams is expressed as the curves indicated by the solid lines shown in FIG. 3. As a result, this patch antenna apparatus has a reduced gain directly above the patch electrode 5, so that the radiation pattern has a flattened shape like a shape compressed from directly above, as indicated by the solid line in FIG. 8, and the maximum radiation direction thereof is obliquely upward (at an elevation angle of about 30°) from the patch electrode 5. In FIG. 8, the radiation pattern indicated by the dotted line is of a comparative example in which the metal frame 3 is absent, and the maximum radiation direction thereof is directly above (the zenith direction) from the patch electrode 5.

As described above, in the patch antenna apparatus according to the first embodiment, the metal frame 3 is disposed around the dielectric substrate 4, to thereby reduce the gain directly above the patch electrode 5. Thus, the beams are shaped so that the maximum radiation direction is at a low elevation angle. The patch antenna apparatus, therefore, can receive incoming signal waves even at an elevation angle of about 20°. Accordingly, even when installed on the roof surface of a vehicle or the like, the patch antenna apparatus can efficiently receive ground waves and signal waves from a low elevation-angle satellite, and thus can be used as a vehicle-mounted small antenna that is preferable for S-band radio broadcasting and the like.

As in the embodiment described above, the plan view shape of the metal frame is preferably similar to that of the outer shape of the dielectric substrate 4, since the space factor improves. However, even if they don't have a similar plan view, substantially the same beam shaping effect can be achieved. Further, as the height dimension of the metal frame 3 is provided closer to that of the dielectric substrate 4, the metal frame 3 can be set lower. However, when a certain degree of spacing is provided between the metal frame 3 and the dielectric substrate 4, the resonant frequency bandwidth can be increased. Thus, as in the embodiment described above, the height dimension of the metal frame 3 is preferably set larger than the thickness dimension of the dielectric substrate 4.

In addition, while current is fed via the two points to receive circularly-polarized waves in the above-described embodiment, the present invention is not limited thereto. For example, the present invention is applicable to a case in which a recessed separating element is provided in the patch electrode 5 so that current is fed thereto via one point to receive circularly-polarized waves. The present invention is also applicable to a case in which linearly-polarized waves are received.

Figure 4:
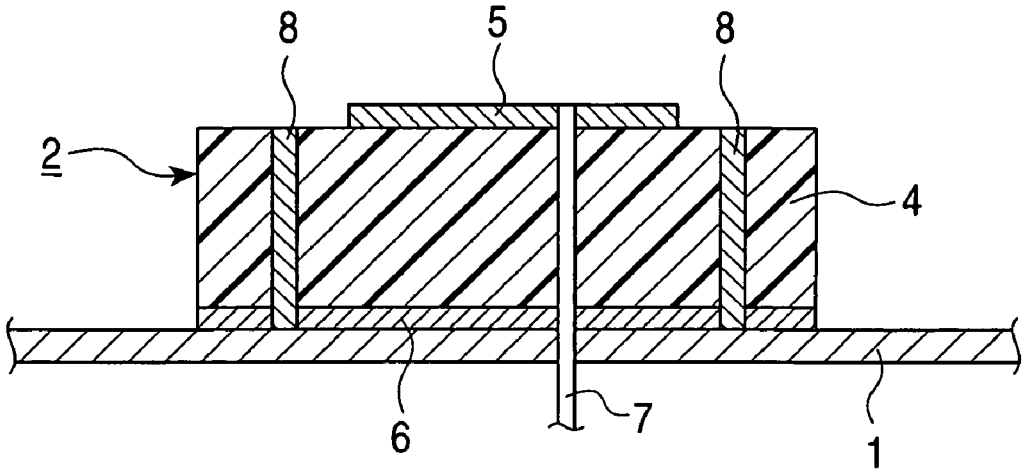
FIG. 4 is a longitudinal sectional view of a patch antenna apparatus according to a second embodiment of the present invention.
Figure 5:
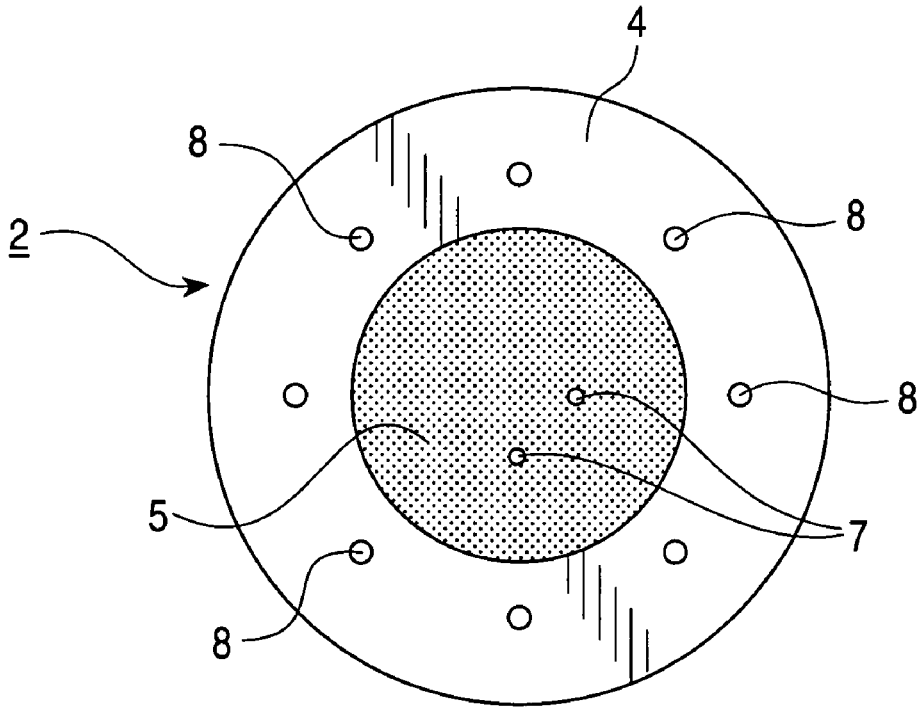
FIG. 5 is a plan view of the patch antenna apparatus of the second embodiment.
Figure 9:
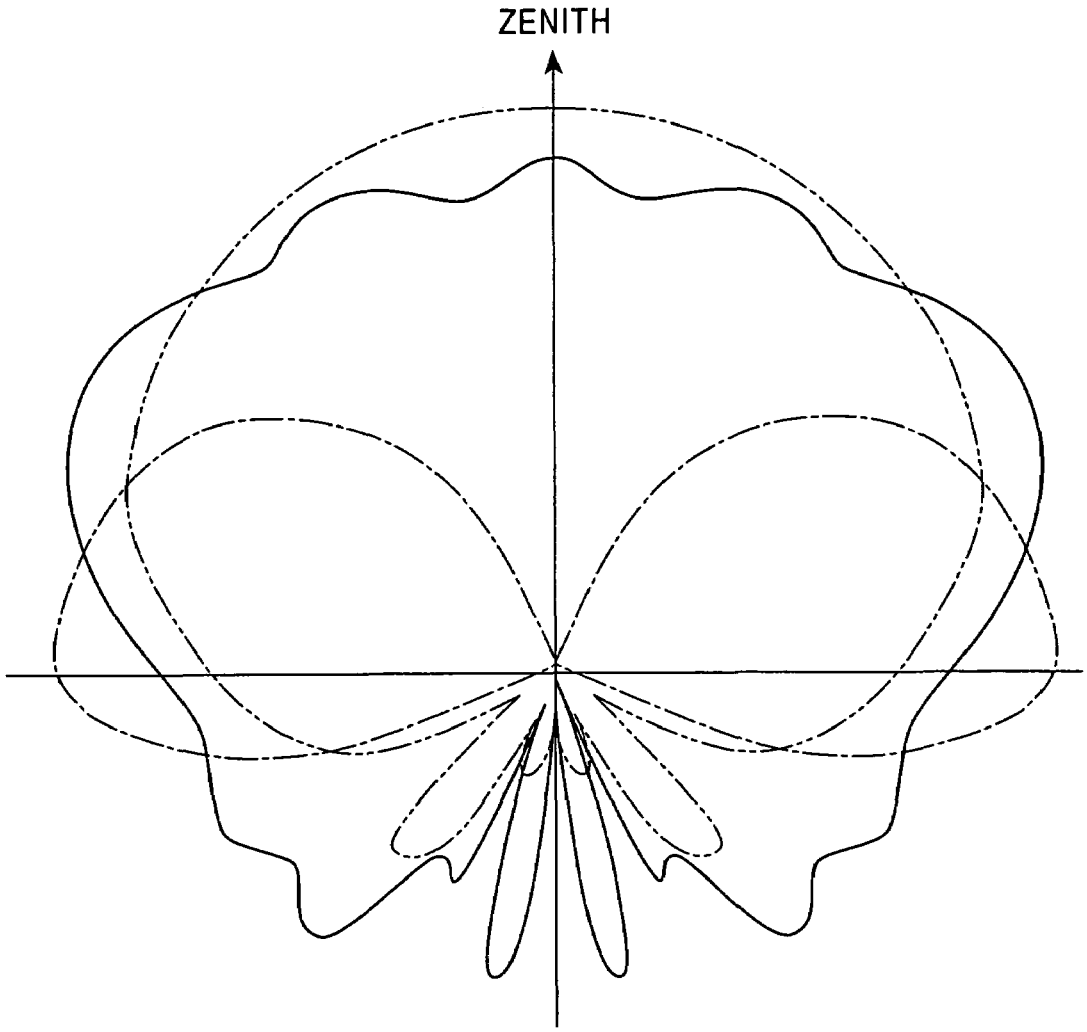
FIG. 9 is a graph showing the radiation pattern of the patch antenna apparatus of the second and third embodiments in conjunction with a comparative example.

A second embodiment of the present invention will now be described with reference to the accompanying drawings. FIG. 4 is a longitudinal sectional view of a patch antenna apparatus according to a second embodiment of the present invention. FIG. 5 is a plan view of the patch antenna apparatus. FIG. 9 is a graph showing the radiation pattern of the patch antenna apparatus in conjunction with a comparative example.

The patch antenna apparatus shown in FIGS. 4 and 5 is constructed such that current-feed means is connected to an antenna element 2 disposed on a ground plane 1. The ground plane 1 is preferably defined by the metal body of a vehicle or the like. The antenna element 2 includes a dielectric substrate 4, a patch electrode 5, a ground electrode 6, current-feed pins 7, and conductive (e.g. metal) pins 8. The dielectric substrate 4 is made of a dielectric material, such as a synthetic resin, and the patch electrode 5 is provided on the top surface of the dielectric substrate 4. The ground electrode 6 is provided on substantially the entire bottom surface of the dielectric substrate 4. The current-feed pins 7 extend through the dielectric substrate 4 and are connected to the patch electrode 5. The current-feed pins 7 are also connected to a current-feed circuit, which is not shown. Outside the patch electrode 5, the metal pins 8 are provided in the dielectric substrate 4 at regular intervals along the circumference direction thereof. Each metal pin 8 extends in the thickness direction of the dielectric substrate 4, and the lower end of the metals pin 8 is connected to the ground plane 1.

In this embodiment, the relative dielectric constant $\in r$ of the dielectric material in the dielectric substrate 4 is again for example $\in r \approx 6$. The patch electrode 5 has a circular shape with a diameter of 16 mm. In order to receive circularly-polarized waves, the current-feed pins 7 are connected to appropriate two points of the patch electrode 5 so that current is fed thereto via the two points. Further, the dielectric substrate 4 is a circular plate with a diameter of 32 mm and a thickness of 6 mm. Along the circumference direction of the dielectric substrate 4, a total of eight metal pins 8 are arranged at an interval of 45°. The thickness of each metal pin 8 is about 1 mm, and the distance between two metal pins 8 that oppose each other along a diameter of the dielectric substrate 4 is set to 24 mm.

In the patch antenna apparatus configured as described above, when a predetermined high-frequency current is fed to the patch electrode 5 via the current-feed pins 7, radio waves (with a frequency of, for example, 2.338 GHz) are radiated in response to a change in the electric field between the patch electrode 5 and the ground plane 1 and/or the ground electrode 6. Thus, when the electric field varies in this manner, current is induced in the metal pins 8 in the dielectric substrate 4. This puts each metal pin 8 into a state in which a current is fed thereto at the same frequency as that of the patch electrode 5, so that each metal pin 8 operates like a monopole antenna. That is, when the metal pins 8 are excited by the induced current, radiation beams whose maximum radiation direction is horizontal are generated as indicated by the dashed-dotted line in FIG. 9. In contrast, when the metal pins 8 are assumed to be absent, the antenna element 2 generates radiation beams whose maximum radiation direction is directly above (the zenith direction), as indicated by the long dashed double-short dashed line in FIG. 9. Thus, the actual radiation pattern, which is obtained by the combination of the two radiation patterns, has a flattened shape like a shape compressed from directly above, as indicated by the solid line in FIG. 9, and the maximum radiation direction thereof is obliquely upward (at an elevation angle of about 30°) from the patch electrode 5.

As described above, in the patch antenna apparatus according to the second embodiment, the plurality of metal pins 8 are arranged in the dielectric substrate 4 along the circumference direction thereof. Thus, the gain directly above the patch electrode 5 is reduced, and the beams are shaped such that the maximum radiation direction is at a low elevation angle. This patch antenna apparatus, therefore, can receive incoming signal waves even at an elevation angle of about 20°. Accordingly, even when installed on the roof surface of a vehicle or the like, this patch antenna apparatus can efficiently receive ground waves and signal waves from a low elevation-angle satellite, and thus can be used as a vehicle-mounted small antenna that is preferable for S-band radio broadcasting and the like.

While eight metal pins 8 are provided in the dielectric substrate 4 along the circumference direction thereof in the above-described embodiment, arranging three or more metal pins 8 at regular intervals allows all directional radiation of significantly uniform waves. Additionally, instead of the metal pins 8, a plurality of through-holes, each serving as a bar-shaped conductor, may be provided in the dielectric substrate 4 along the circumference direction of the dielectric substrate 4. This arrangement can provide substantially the same advantages as the above-described embodiment.

While current is fed via the two points to receive circularly-polarized waves in the above-described embodiment, the present invention is not limited thereto. For example, the present invention is applicable to a case in which a recessed separating element is provided in the patch electrode 5 so that current is fed thereto via one point to receive circularly-polarized waves. The present invention is also applicable to case in which linearly-polarized waves are received. Additionally, the dielectric substrate 4 and the patch electrode 5 may have a rectangular shape in plan view.

Figure 6:
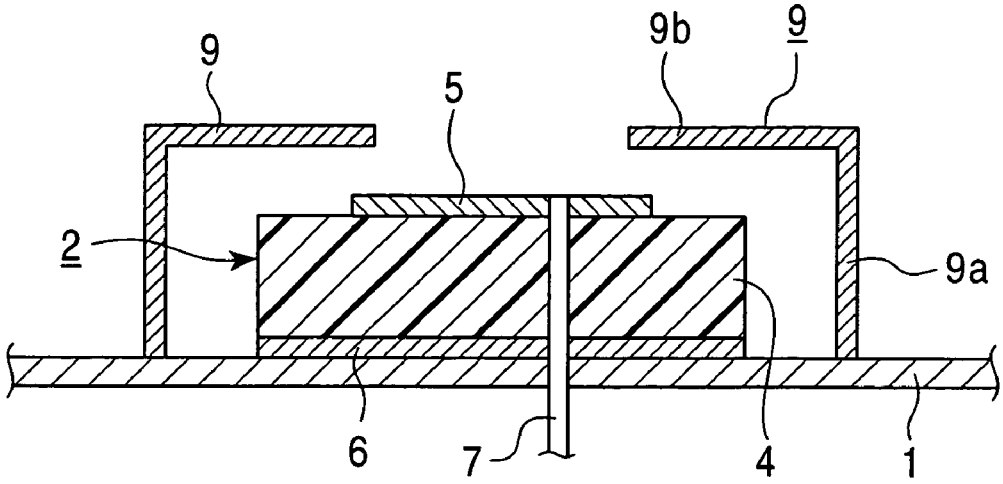
FIG. 6 is a longitudinal sectional view of a patch antenna apparatus according to a third embodiment of the present invention.
Figure 7:
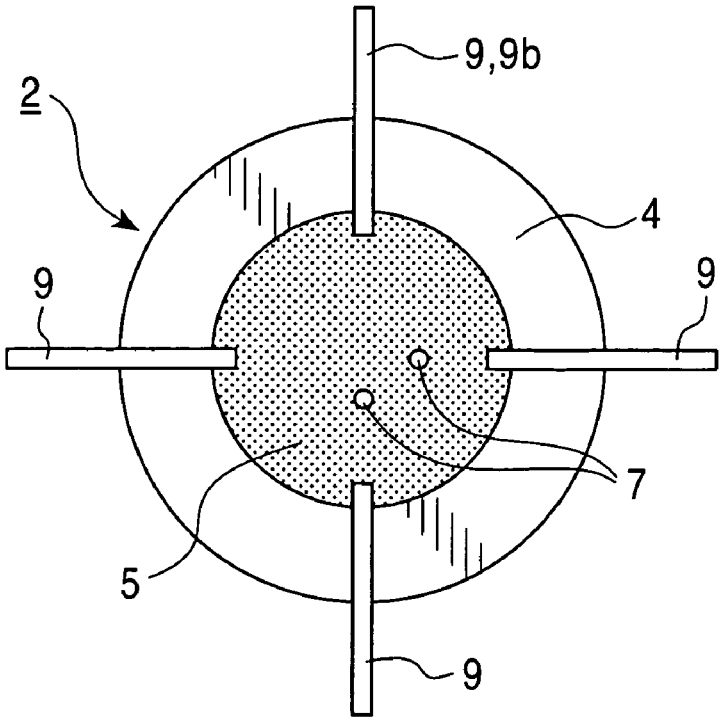
FIG. 7 is a plan view of the patch antenna apparatus of the third embodiment.

A third embodiment of the present invention will now be described with reference to the accompanying drawings. FIG. 6 is a longitudinal sectional view of a patch antenna apparatus according to a third embodiment of the present invention. FIG. 7 is a plan view of the patch antenna apparatus. FIG. 9 is a graph showing the radiation pattern of the patch antenna apparatus in conjunction with a comparative example.

The patch antenna apparatus shown in FIGS. 6 and 7 is generally constructed such that one antenna element 2 and four metal pins 9 are disposed on a ground plane 1. The ground plane 1 is preferably defined by the metal body of a vehicle or the like. The antenna element 2 includes a dielectric substrate 4, a patch electrode 5, a ground electrode 6, and current-feed pins 7. The dielectric substrate 4 is made of a dielectric material, such as a synthetic resin, and the patch electrode 5 is provided on the top surface of the dielectric substrate 4. The ground electrode 6 is provided on substantially the entire bottom surface of the dielectric substrate 4, and the current-feed pins 7 extend through the dielectric substrate 4, and are connected to the patch electrode 5. The current-feed pins 7 are also connected to a current-feed circuit, which is not shown.

The four conductive (e.g. metal) pins 9 are arranged at regular intervals around the antenna element 2. Each metal pin 9 has a substantially "L" shape with an upright portion 9*a* and a lateral portion 9*b*. The upper end of the upright portion 9*a* (i.e., the base end of the lateral portion 9*b*) is bent at a substantially right angle. The lower end of the upright portion 9*a* is connected with the ground plane 1, and the upright portion 9*a* extends in the thickness direction of the dielectric substrate 4. The lateral portion 9*b* extends in a radial direction of the dielectric substrate 4 so as to be parallel to the top surface of the dielectric substrate 4 and the patch electrode 5.

In this embodiment, the relative dielectric constant $\epsilon r$ of the dielectric material in the dielectric substrate 4 is again, for example, $\in r \approx 6$. The patch electrode 5 has a circular shape with a diameter of 20 mm. In order to receive circularly-polarized waves, the current-feed pins 7 are connected to appropriate two points of the patch electrode 5 and current is fed thereto via the two points. Further, the dielectric substrate 4 is a circular plate having a diameter of 32 mm and a thickness of 6 mm. Along the peripheral surface of the dielectric substrate 4, a total of four metal pins 9 are arranged at an interval of 90°. Further, the distance between the upright portions 9*a* of two metal pins 9 that oppose each other along the radial direction of the dielectric substrate 4 is 36 mm, the height of the upright position 9*a* is 8.5 mm, and the length of the lateral portion 9*b* is 8 mm.

In the patch antenna apparatus configured as described above, when a predetermined high-frequency current is fed to the patch electrode 5 via the current-feed pins 7, radio waves (with a frequency of, for example, 2.338 GHz) are radiated in response to a change in the electric field between the patch electrode 5 and the ground plane 1 and/or the ground electrode 6. Some of the radio waves radiated in that manner are received by the metal pins 9, and the upright portions 9*a* serve as radiating conductors, thereby re-radiating radio waves. The radiation pattern of the radio waves re-radiated by each upright portion 9*a*, which serves as a radiating conductor, is analogous to that of a monopole antenna. Thus, the maximum radiation direction becomes horizontal as indicated by the dashed-dotted line in FIG. 9. In contrast, when the metal pins 9 are assumed to be absent, the antenna element 2 generates radiation beams whose maximum radiation direction is directly above (the zenith direction), as indicated by the long dashed double-short dashed line in FIG. 9. Thus, the actual radiation pattern, which is obtained by the combination of the two radiation patterns, has a flattened shape like a shape compressed from directly above, as indicated by the solid line in FIG. 9, and the maximum radiation direction thereof is obliquely upward (at an elevation angle of about 30°) from the patch electrode 5.

As described above, in the patch antenna apparatus according to this embodiment, the plurality of metal pins 9 are arranged around the antenna element 2, to thereby reduce the gain directly above the patch electrode 5. Thus, the beams are shaped so that the maximum radiation direction is at a low elevation angle. This patch antenna apparatus, therefore, can receive incoming signal waves even at an elevation angle of about 20°. Accordingly, even when installed on the roof surface of a vehicle or the like, this patch antenna apparatus can efficiently receive ground waves and signal waves from a low elevation-angle satellite, and thus can be used as a vehicle-mounted small antenna that is preferable for S-band radio broadcasting and the like.

While four metal pins 9 are arranged along the peripheral surface of the dielectric substrate 4 at regular intervals, the number of metal pins 9 may be five or more. Also, when three metal pins 9 are arranged at regular intervals, significantly uniform waves can be radiated in all directions. Additionally, each metal pin 9 may have a substantially L shape with the upright portion 9*a* and the lateral portion 9*b* forming an obtuse angle. Such an arrangement can provide substantially the same advantages as the above-described embodiment.

In addition, each metal pin 9 may have a substantially "I" shape having only the upright portion 9*a*. In this case, a metal plate is disposed in the horizontal direction above the dielectric substrate 4 so as continue to the upper end of the upright portions 9*a*. With this arrangement, radio waves radiated from the antenna element 2 can be received by the metal plate and can be re-radiated from the metal pins 9. In this case, for example, the upper ends of the metal pins 9 can be connected to corresponding spots at outer edges of the metal plate, which may have a ring shape.

In addition, although the dielectric substrate 4 and the patch electrode 5 have a circular shape in plan view in the above described embodiment, the present invention is also applicable to a case in which they have a rectangular shape in plan view. Further, while current is fed via the two points to receive circularly-polarized waves in the above-described embodiment, the present invention is not limited thereto. For example, the present is applicable to a case in which a recessed separating element is provided in the patch electrode 5 so that current is fed via thereto one point to receive circularly-polarized waves. The present invention is also applicable to a case in which linearly-polarized waves are received.

What is claimed:

1. A patch antenna apparatus comprising:

a ground plane;

a dielectric substrate disposed above the ground plane;

a patch electrode provided on a surface of the dielectric substrate opposing the ground plane;

a ground electrode disposed between the ground plane and the dielectric substrate;

current-feed means connected to the patch electrode; and a metal frame surrounding a peripheral surface of the dielectric substrate.

2. The patch antenna apparatus according to claim 1, wherein the height dimension of the metal frame is larger than the thickness dimension of the dielectric substrate.

3. The patch antenna apparatus according to claim 1, wherein a plan-view shape of the metal frame is substantially similar to a plan-view shape of the outer shape of the dielectric substrate.

4. The patch antenna apparatus according to claim 1, wherein the current-feed means comprises a current-feed pin connected to the patch electrode to permit the patch antenna to receive circularly-polarized waves.

5. The patch antenna apparatus according to claim 1, wherein a distance between the dielectric substrate and the metal frame are substantially uniform.

6. The patch antenna apparatus according to claim 1, wherein an area of the dielectric substrate is larger than an area of the patch electrode.

7. A patch antenna apparatus comprising:

a ground plane;

a dielectric substrate disposed above the ground plane;

a patch electrode provided on a surface of the dielectric substrate opposing the ground plane;

a ground electrode disposed between the ground plane and the dielectric substrate;

current-feed means connected to the patch electrode; and at least three bar-shaped conductors, each extending in a thickness direction of the dielectric substrate, arranged in the dielectric substrate along a circumference direction of the dielectric substrate, the bar-shaped conductors disposed outside the patch electrode, and lower ends of the bar-shaped conductors connected to the ground plane.

8. The patch antenna apparatus according to claim 7, wherein metal pins provided in the dielectric substrate serve as the bar-shaped conductors.

9. The patch antenna apparatus according to clam 7, wherein through-holes provided in the dielectric substrate serve as the bar-shaped conductors.

10. The patch antenna apparatus according to claim 7, wherein the current-feed means comprises a current-feed pin connected to the patch electrode to permit the patch antenna to receive circularly-polarized waves.

11. The patch antenna apparatus according to claim 7, wherein an area of the dielectric substrate is larger than an area of the patch electrode.

12. The patch antenna apparatus according to claim 7, wherein the conductors are disposed at regular intervals along the circumference direction.

13. The patch antenna apparatus according to claim 7, wherein a plan-view shape of the dielectric substrate is substantially similar to a plan-view shape of the patch electrode.

14. The patch antenna apparatus according to claim 13, wherein the plan-view shapes of the dielectric substrate and the patch electrode are circular.

15. The patch antenna apparatus according to claim 7, wherein the bar-shaped conductors extend through the ground electrode to the ground plane.

16. The patch antenna apparatus according to claim 7, wherein the bar-shaped conductors terminate at the surface of the dielectric substrate opposing the ground plane.

17. A patch antenna apparatus comprising:

a ground plane;

a dielectric substrate disposed above the ground plane;

a patch electrode provided on a top surface of the dielectric substrate opposing the ground plane;

currant-feed means connected to the patch electrode; and at least three metal pins, each having an upright portion extending in a thickness direction of the dielectric substrate, arranged at substantially regular Intervals around the dielectric substrate, a lower end of each metal pin connected to the ground plane and an upper end of the upright portion of each metal pin continues to a lateral metal member that is arranged above the dielectric substrate.

18. The patch antenna apparatus according to claim 17, wherein each metal pin is a pin member in which the upper end of the upright portion is bent and the lateral metal member extends from the bent portion.

19. The patch antenna apparatus according to claim 18, wherein the metal pin has a substantially L shape, the upper end of the upright portion being bent at a substantially right angle.

20. The patch antenna apparatus according to claim 18, wherein an end of the lateral metal member is disposed above the patch antenna.

21. The patch antenna apparatus according to claim 17, wherein a plan-view shape of the dielectric substrate is substantially similar to a plan-view shape of the patch electrode.

22. The patch antenna apparatus according to claim 21, wherein the plan-view shapes of the dielectric substrate and the patch electrode are circular.

23. The patch antenna apparatus according to claim 17, wherein the current-feed means comprises a current-feed pin connected to the patch electrode to permit the patch antenna to receive circularly-polarized waves.

24. The patch antenna apparatus according to claim 17, wherein a lateral distance between the dielectric substrate and each metal pin are substantially uniform.

25. The patch antenna apparatus according to claim 17, wherein an area of the dielectric substrate is larger than an area of the patch electrode.

26. The patch antenna apparatus according to claim 17, further comprising a ground electrode disposed between the ground plane and the dielectric substrate.

27. A patch antenna apparatus comprising:

a ground plane;

a dielectric substrate disposed on the ground plane;

a patch electrode provided on a surface of the dielectric substrate opposing the ground plane and connected to current-teed means;

a ground electrode disposed between the ground plane and the dielectric substrate; and redirection means for redirecting a direction of radiation from the patch antenna such that a direction in which the radiation is maximized is oblique to a direction perpendicular to the surface of the dielectric substrate.

28. The patch antenna apparatus according to claim 27, wherein redirection means redirects the radiation such that the maximum radiation direction is at an elevation angle of about 30° from a plane perpendicular to the surface of the dielectric substrate.

29. The patch antenna apparatus according to claim 27, wherein redirection means redirects the maximum radiation away from the perpendicular direction.

30. The patch antenna apparatus according to claim 27, wherein the redirection means is laterally separated from and disposed at discrete intervals around the patch electrode.

31. The patch antenna apparatus according to claim 30, wherein the redirection means is laterally separated from the dielectric substrate.

32. The patch antenna apparatus according to claim 31, wherein the redirection means extends over the dielectric substrate.

33. The patch antenna apparatus according to claim 31, wherein the redirection means extends over the patch electrode.

34. The patch antenna apparatus according to claim 30, wherein the redirection means is disposed in the dielectric substrate.

35. The patch antenna apparatus according to claim 30, wherein the redirection means extends over the dielectric substrate.

36. The patch antenna apparatus according to claim 30, wherein the redirection means extends over the patch electrode.

37. The patch antenna apparatus according to claim 27, wherein the redirection means is laterally separated from and disposed continuously around the patch electrode.

38. The patch antenna apparatus according to claim 37, wherein an end of the redirection means is more distal from the ground plane than the patch electrode.

* * * * *

UNITED STATES PATENT AND TRADEMARK OFFICE

CERTIFICATE OF CORRECTION

PATENT NO. : 7,079,078 B2
APPLICATION NO. : 10/812334
DATED : July 18, 2006
INVENTOR(S) : Dou Yuanzhu It is certified that error appears in the above-identified patent and that said Letters Patent is hereby corrected as shown below:

Column 10, in claim 17, line 9, after "substantially regular" delete "Intervals" and substitute --intervals-- in its place.

Column 10, in claim 27, line 6, before "means;" delete "current-teed" and substitute --current-feed-- in its place.

Signed and Sealed this

Nineteenth Day of December, 2006

JON W. DUDAS
*Director of the United States Patent and Trademark Office*